United States Patent [19]

Abild

[11] 3,954,349

[45] May 4, 1976

[54] LEVER CONNECTION TO SYNCRING

[75] Inventor: Robert N. Abild, New Britain, Conn.

[73] Assignee: United Technologies Corporation, Hartford, Conn.

[22] Filed: June 2, 1975

[21] Appl. No.: 583,128

[52] U.S. Cl. ..... 415/163; 415/160
[51] Int. Cl.[2] ..... F01D 17/00; F01D 17/16
[58] Field of Search ..... 415/160, 163, 164, 149; 94/579 E

[56] References Cited

UNITED STATES PATENTS

| | | | |
|---|---|---|---|
| 2,064,313 | 12/1936 | Moody | 415/163 |
| 2,305,311 | 12/1942 | Jendrassik | 415/149 |
| 2,854,211 | 9/1958 | Bendersky | 415/160 |

*Primary Examiner*—Henry F. Raduazo
*Attorney, Agent, or Firm*—Charles A. Warren

[57] ABSTRACT

A mechanical joint for connecting each of the actuating levers on a row of variable position engine vanes to a common synchronizing ring including a flattened cylindrical slider fitting in a cylindrical recess in the actuating lever and having a stepped hole to receive a substantially radially extending pin in the synchronizing ring.

4 Claims, 4 Drawing Figures

LEVER CONNECTION TO SYNCRING

BACKGROUND OF THE INVENTION

In multiple stage axial flow compressors it has frequently been desirable to adjust the position of all of the individual vanes in one or more rows of stator vanes, thereby varying the flow area and/or angle of discharge to improve the performance of the associated compressor stage and thereby the performance of the compressor. It is desirable that the connections between the individual vanes of the row and the synchronizing ring by which the vanes are actuated be formed to minimize looseness in order to achieve the desired precision of cooperative action between the turning motion of the ring on an axis concentric to the compressor and the pivotal movement of the vane on a substantially radial axis. The mechanisms disclosed also provide area contact between sliding surfaces rather than point or line contact, thus minimizing surface stress and wear.

The invention herein described was made in the course of or under a contract or subcontract thereunder, with the Department of the Navy.

SUMMARY OF THE INVENTION

According to the present invention each vane carries a lever at one end and this lever is connected to the synchronizing ring through a flattened cylindrical slider fitting in a cylindrical slot in the actuating lever and having a substantially radial hole to receive a pin carried by the synchronizing ring. More specifically, the ring is channel shaped to accept the end of the lever in the channel, and the hole in the slider engages the pin between its ends which are supported by the synchronizing ring.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Figure 1:
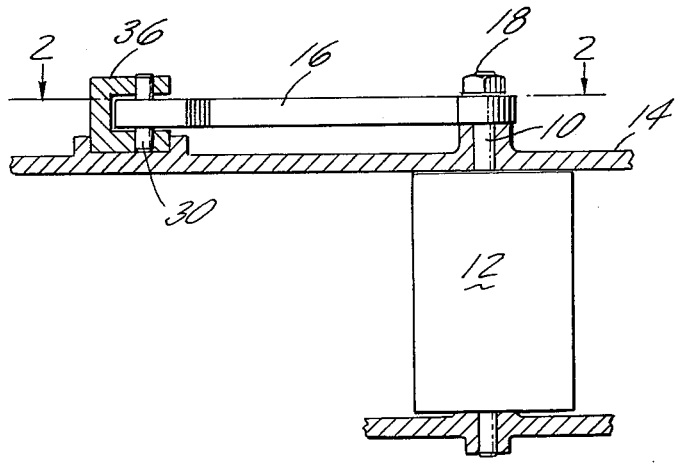
FIG. 1 is a fragmentary sectional view through a compressor case and vane structure.

Referring first to FIG. 1, the stub shaft 10 projecting from the outer end of the vane 12 is pivoted in the compressor casing 14 and has mounted on the outer end an actuating lever 16, being held thereon as by a nut 18. Such a construction is well known in the art as for example the Corsmeier Pat. No. 3,356,288.

Figure 2:
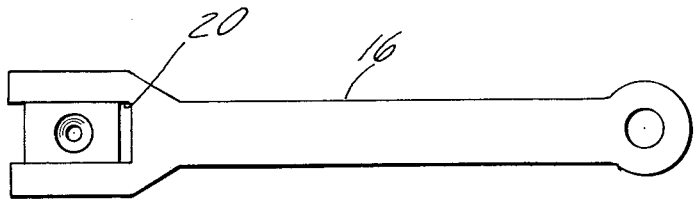
FIG. 2 is a sectional view along line 2—2 of FIG. 1.
Figure 3:
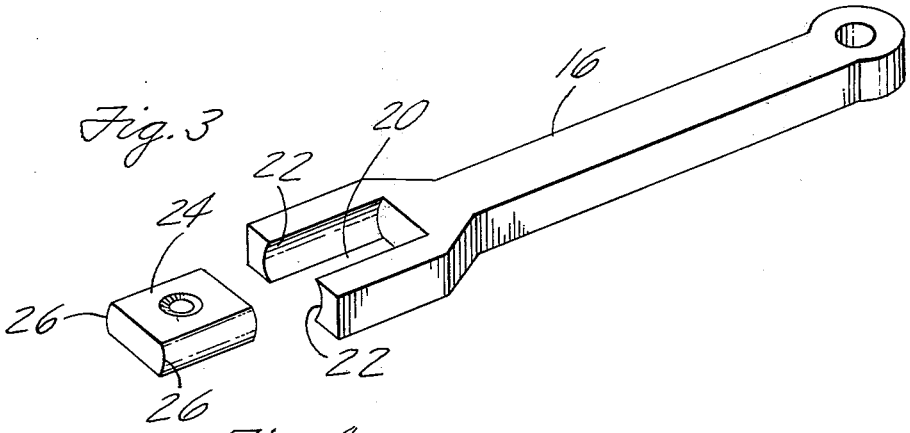
FIG. 3 is a developed view of the interconnection between the lever and the ring.

The free end of the lever 16 has a slot 20, FIG. 2, therein, the side walls of which are parallel to the centerline of the lever. These side walls are arcuate and form together the opposite sides of a cylindrical recess 22. Fitting in this recess is a block 24, the opposite sides 26 of which are cylindrical and of a dimension to fit in and slide on the side walls of the cylindrical recess 22. This block is thus a flattened cylindrical slider.

Figure 4:
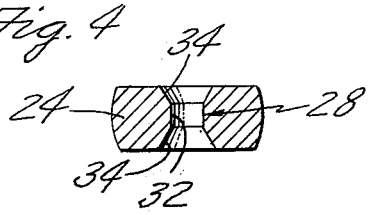
FIG. 4 is an enlarged sectional view through the sliding block.

This block or slider 24 has a central opening 28 therethrough to receive a pin 30, FIG. 1, by which the lever is actuated. The central opening as shown in FIG. 4, has a central cylindrical portion 32 closely fitting the pin 30 and tapered end portions 34 to permit a freedom of movement for the pin at the ends of the hole. The block 24 is free to slide endwise within the cylindrical slot in the lever and to pivot on an axis coincident with the axis of the slot.

As shown in FIG. 1, the pin 30 is carried in a ring 36 circumferentially movable on the casing 14, the pin extending substantially radially through the ring. The actuating ring is U-shaped with the open end of the U facing toward the lever. The pin is carried by the opposite sides of the U and the block 24 has its opposed surfaces flattened to fit within the ring but out of contact with the opposite sides of the ring. Similarly, the slotted end of the lever is substantially the same thickness as the block so that the end of the lever also fits readily within the actuating ring. As the ring is moved circumferentially on the casing the pin 30 carries the block 24 with it, thus turning the lever 16 and providing a corresponding turning movement of the vane. The present structure is of particular value since it minimizes the looseness necessary to accommodate the relative movements, thereby assuring a precise movement of the vane. It will be understood that the above-described mechanism is only one of many duplicate mechanisms connected to the actuating ring. Each of the many vanes forming the row of vanes is similarly connected to the actuating ring and all must move freely to permit the desired adjustment of the many vanes simultaneously to control the performance of the stage of the device of which this row of vanes forms a part.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of my invention, that which I claim as new and desire to secure by Letters Patent of the United States is:

1. In an axial flow compressor having a casing, a row of vanes carried by said casing and positioned substantially radially therein, each vane of the row being turnable on its radial axis to change the angle of the vane, and a ring positioned on and extending around the casing, said ring by circumferential movement actuating the vanes, in combination with actuating means for each of the vanes including:

a lever attached to the vane and moving therewith, said lever having a slot in the end remote from the vane, said slot having opposed cylindrical side surfaces, a block slidably fitting in said slot and having opposed cylindrical sides cooperating with the surfaces of the slot, the cylindrical axis of the slot surfaces and block surfaces being parallel to the longitudinal axis of the lever, said block having a central hole therethrough at right angles to the cylindrical axis, and a pin carried by and positioned substantially radially of the ring on the casing and extending through the central hole of the block.

2. An actuating means for use in an axial flow compressor as in claim 1 in which the central hole in the block has a central portion corresponding in dimension to the pin and outwardly tapered portions from opposite ends of the central portion to the opposite surfaces of the block.

3. An actuating means for use in an axial compressor as in claim 1 in which the block has opposed flattened surfaces to fit within the actuating ring, the latter being U-shaped to receive the block.

4. An actuating means for use in an axial flow compressor as in claim 1 in which the slotted end of the lever is also less thick than the U-shaped ring to be received therein.

* * * * *